US012631070B2

(12) United States Patent
Torres et al.

(10) Patent No.: US 12,631,070 B2
(45) Date of Patent: May 19, 2026

(54) SUBTERRANEAN DRILL BITS HAVING SHANK BYPATHS

(71) Applicant: Ulterra Drilling Technologies, L.P., Fort Worth, TX (US)

(72) Inventors: Jeremiah Torres, Fort Worth, TX (US); Thomas Simatic, Fort Worth, TX (US)

(73) Assignee: ULTERRA DRILLING TECHNOLOGIES, L.P., Fort Worth, TX (US)

( * ) Notice: Subject to any disclaimer, the term of this patent is extended or adjusted under 35 U.S.C. 154(b) by 0 days.

(21) Appl. No.: 18/511,306

(22) Filed: Nov. 16, 2023

(65) Prior Publication Data

US 2025/0163762 A1 May 22, 2025

(51) Int. Cl.

| | |
|---|---|
| ***E21B 10/60*** | (2006.01) |
| ***E21B 3/00*** | (2006.01) |
| ***E21B 10/42*** | (2006.01) |
| ***E21B 10/567*** | (2006.01) |

(52) U.S. Cl.

CPC ..... *E21B 10/602* (2013.01); *E21B 10/42* (2013.01); *E21B 3/00* (2013.01); *E21B 10/567* (2013.01)

(58) Field of Classification Search

CPC ..... E21B 10/602

See application file for complete search history.

(56) References Cited

U.S. PATENT DOCUMENTS

| | | | | |
|---|---|---|---|---|
| 2,710,741 | A * | 6/1955 | Hall, Sr. | E21B 21/00 166/99 |
| 3,215,215 | A | 11/1965 | Kellner | |
| 4,445,580 | A * | 5/1984 | Sahley | E21B 10/003 175/413 |
| 4,463,220 | A * | 7/1984 | Gonzalez | E21B 10/60 175/322 |
| 4,515,227 | A | 5/1985 | Cerkovnik | |
| 4,540,055 | A * | 9/1985 | Drummond | E21B 21/16 175/323 |
| 4,618,010 | A * | 10/1986 | Falgout, Sr. | E21B 17/10 175/430 |
| 8,905,162 | B2 * | 12/2014 | Torres | E21B 10/602 175/323 |
| 2006/0213693 | A1 * | 9/2006 | Zahradnik | E21B 10/42 175/374 |
| 2010/0147594 | A1 * | 6/2010 | Ben Lamin | E21B 10/60 175/340 |
| 2018/0230753 | A1 * | 8/2018 | Omidvar | E21B 10/265 |
| 2021/0180408 | A1 | 6/2021 | Clark et al. | |

OTHER PUBLICATIONS

International Application No. PCT/US2024/053394, International Search Report and Written Opinion, Mailed On Jan. 8, 2025, 13 pages.

* cited by examiner

*Primary Examiner* — Blake Michener
(74) *Attorney, Agent, or Firm* — Kilpatrick Townsend & Stockton LLP

(57) ABSTRACT

Provided herein are PDC drill bits for engaging subterranean formations and for drilling wellbores, wherein the PDC drill bits are adapted to reduce erosion of a bit head face by the inclusion of openings in a portion of the shank of a PDC drill bit. The present disclosure also relates to systems and methods of drilling subterranean formations using the PDC drill bits disclosed herein.

19 Claims, 6 Drawing Sheets

SUBTERRANEAN DRILL BITS HAVING SHANK BYPATHS

FIELD

The present disclosure relates generally to drill bits for engaging subterranean formations and for drilling wellbores. More specifically, the present disclosure relates to polycrystalline-diamond compact drill bits having shank bypath channels adapted to reduce erosion of the drill bit face. The present disclosure also relates to methods of drilling subterranean formations using the drill bits disclosed herein.

BACKGROUND

Polycrystalline-diamond compact (PDC) drill bits are a type of rotary drill bit used for boring through subterranean formations, e.g., when drilling wellbores for oil, natural gas, geothermal, mining, and/or water wells. A typical PDC drill bit includes a PDC bit head welded to a shank, which is usually removably connected to a drill string. As a PDC drilling assembly is rotated, a discrete cutting structure affixed to the face of the bit engages with the rock walls at the bottom of the well, scraping or shearing the formation. PDC bits use cutting structures, referred to as "cutters," each having a cutting surface or wear surface comprised of a PDC, hence the designation "PDC drill bit." Each PDC cutter is a discrete piece, separate from the drill bit, and is fabricated by bonding a layer of polycrystalline diamond, sometimes called a crown or diamond table, to a substrate. PDC, though very hard and abrasion resistant, tends to be brittle. The substrate, while still very hard, is tougher, thus improving the impact resistance of the cutter. The substrate is typically made long enough to act as a mounting stud, e.g., by fitting a portion into a pocket or recess formed in the body of the bit. In some designs, the PDC (polycrystalline diamond table (PCD)+substrate) is brazed onto the bit head. Because of the processes used for fabricating the PDC cutter, the cutting surface and substrate typically have a cylindrical shape, with a relatively thin diamond table bonded to a taller or longer cylinder of substrate material. The resulting composite can be machined or milled to change its shape. However, the PDC layer and substrate are most often used on PDC bits in the cylindrical form in which they are made.

Each PDC cutter of a rotary drag bit may be positioned and oriented on a face of the drag bit so that at least a portion of the cutting surface engages the subterranean formation as the bit is being rotated. The PDC cutters are spaced apart on an exterior cutting surface or face of the body of the bit head. The PDC cutters are typically arrayed along each of several blades, which are raised ridges extending generally radially from the central axis of the bit, toward the periphery of the face. The PDC cutters along each blade present a predetermined cutting profile to the subterranean formation, shearing the formation as the bit rotates.

A drilling fluid, such as drilling mud or a pneumatic fluid, may be pumped down the drill string, into a central passageway formed in the center of the bit, and then out through openings formed in the face of the bit. Drilling fluid can serve many purposes. For example, the drilling fluid may be used to cool, lubricate, or otherwise clean the cutters or other components of the drill string, to remove and carry cuttings from the well, to suspend and release cuttings, to seal formations, to transmit hydraulic or pneumatic energy to the tools, to convey measurements to the surface, to control corrosion, and/or to facilitate cementing.

Many conventional drilling methods use liquid drilling fluids (i.e., hydraulic fluids) that are generally incompressible when employing PDC bits due to erosion issues. Other drilling methods use air-based fluids (i.e., pneumatic fluids) as the drilling fluid, which typically involves the combination of stable, competent formations, and relatively low formation pressures. Air-based fluids (i.e., pneumatic fluids) are often used, for example, in mining, and in blast hole drilling.

While drilling fluid is an important aspect of downhole drilling and serves numerous desirable purposes, it has been found that drilling fluid also has negative effects. In particular, drilling fluid can cause severe erosion on the bit head and/or the PDC cutters of the bit head. Such erosion is undesirable, because it can reduce the operable life of a drill bit and/or may contribute to failure of the drilling system altogether.

Furthermore, it has been found that some drilling fluid mixtures, in particular pneumatic fluids, present an especially high risk of bit erosion. More specifically, severe erosion can occur in cutter substrates or at the base of blades of the drill bit, which can lead to cutter failure and/or blade failure. For example, cracks may form on the PDC cutters and may cause the separation of a portion of the cutting face from the substrate, rendering the PDC cutters ineffective or resulting in PDC cutter failure. When this happens, drilling operations may have to cease to allow for recovery of the drag bit and for replacement of the ineffective or failed cutting element.

In addition, erosion due to drilling fluids can contribute to cutter substrate erosion. Cutter substrate erosion is a particularly costly problem. During typical operation, the cutter face may slowly dull or erode as a result of, e.g., conventional wear. So long as the cutter includes a sharp cutting edge around a substantial portion of the circumference (e.g., about one-third of the circumference), the cutter can still be used without issue. For example, a lightly worn cutter can be rotated on the drill be to expose a fresh, sharp edge. Cutter substrate erosion prevents this. As the substrate of the cutter becomes damaged, it cannot be securely fixed (e.g., brazed) to the bit head. As a result, the cutter must be discarded well before its face becomes dull. This reduced life greatly adds to operation costs.

Thus, the need exists for drill bits that can reduce stresses and erosion imposed during drilling to improve operating life. Additionally, the need exists for PDC drill bits that cut efficiently at designed speed, flow rates, and drilling conditions in downhole drilling environments to regulate the amount of cutting load in changing formations.

SUMMARY

The present disclosure relates to a drill bit, comprising a shank comprising a shank body defining a longitudinally extending shank bore, wherein the shank body includes at least one shank bypath extending from the shank bore to a shank outer surface; and a bit head connected to the shank, the bit head comprising a body comprising a gauge for engaging a side of a well bore and a face for engaging a bottom of the well bore, a plurality of blades separating a plurality of channels, wherein the plurality of channels extend radially along a portion of the face and extend longitudinally along a portion of the gauge, a central pathway formed through the body and in fluid communication with the shank bore for providing a fluid to the plurality of channels through at least one first opening, and wherein at least one of the plurality of blades comprises an edge on which is mounted a plurality of cutters arranged for shearing the bottom of the well bore.

In various optional embodiments, the shank bypath extends radially from the shank bore to the shank outer surface. The shank bypath optionally has an average width from ⅛ to 1 inch (1.3 cm to 2.5 cm) and optionally extends radially from the shank bore to the shank outer surface. The shank bypath optionally extends from the shank bore to the shank outer surface at an angle $\alpha 2$ less than 90°, optionally at an uphole angle $\alpha 2$ from 10° to 80°, at an uphole angle $\alpha_2$ from 20° to 60°, or at an uphole angle $\alpha 2$ from 45° to 60°. In other aspects, the shank bypath extends from the shank bore to the shank outer surface at a downhole angle $\alpha 2$ relative to the longitudinal axis, optionally at a downhole angle 2 greater than 90° and less than 135°, or at a downhole angle $\alpha 2$ from 100° to 130°. In some aspects, the shank bypath extends from the shank bore to the shank outer surface at an angle $\alpha 2$ of about 90°.

In some aspects, the shank bypath includes a shank opening comprising a nozzle. The bit head may further comprise at least one bit bypath extending from the central pathway to a channel within a portion of the gauge. The bit head optionally does not include a bit bypath extending from the central pathway to a channel within a portion of the gauge. In some embodiments, each channel of the plurality the channels comprises a width, a depth, a combination of the width and the depth, or a cross-sectional area that is substantially constant within at least a portion of each of the plurality of channels. In this aspect, the width and the depth of each of the plurality of channels optionally remains substantially constant within the portion of each of the plurality of channels. The cross-sectional area of each of the plurality of channels optionally remains substantially constant within the portion of each of the plurality of channels.

In another embodiment, the disclosure relates to a method for drilling a well bore through a subterranean formation, the method comprising: (a) rotating a drill bit comprising (i) a shank comprising a shank body defining a longitudinally extending shank bore, wherein the shank body includes at least one shank bypath extending from the shank bore to a shank outer surface; and (ii) a bit head connected to the shank, the bit head comprising a body comprising a gauge for engaging a side of a well bore and a face for engaging a bottom of the well bore, a plurality of blades separating a plurality of channels, wherein the plurality of channels extend radially along a portion of the face and extend longitudinally along a portion of the gauge, a central pathway formed through the body and in fluid communication with the shank bore for providing a fluid to the plurality of channels through at least one first opening, and a wherein at least one of the plurality of blades comprises an edge on which is mounted a plurality of cutters arranged for shearing the bottom of the well bore; (b) engaging the well bore with the plurality of cutters to form rock cuttings, wherein the rock cuttings are conveyed into the plurality of channels; and (c) pumping a fluid through at least a portion of the shank bore, through the shank bypath, and into an annular space between the shank outer surface and the side of the well bore.

The method optionally further comprises pumping the fluid into the channels, wherein the fluid pumped into the channels provides a first volume of the fluid, wherein the fluid pumped into the annular space via the shank bypath provides a second volume of the fluid, and wherein the ratio of the first volume to the second volume is greater than 1. The fluid optionally comprises a compressible pneumatic fluid and/or drilling mud.

BRIEF DESCRIPTION OF THE DRAWINGS

The disclosure is described in detail below with reference to the appended drawings, wherein like numerals designate similar parts.

DETAILED DESCRIPTION

Introduction

Figure 1:
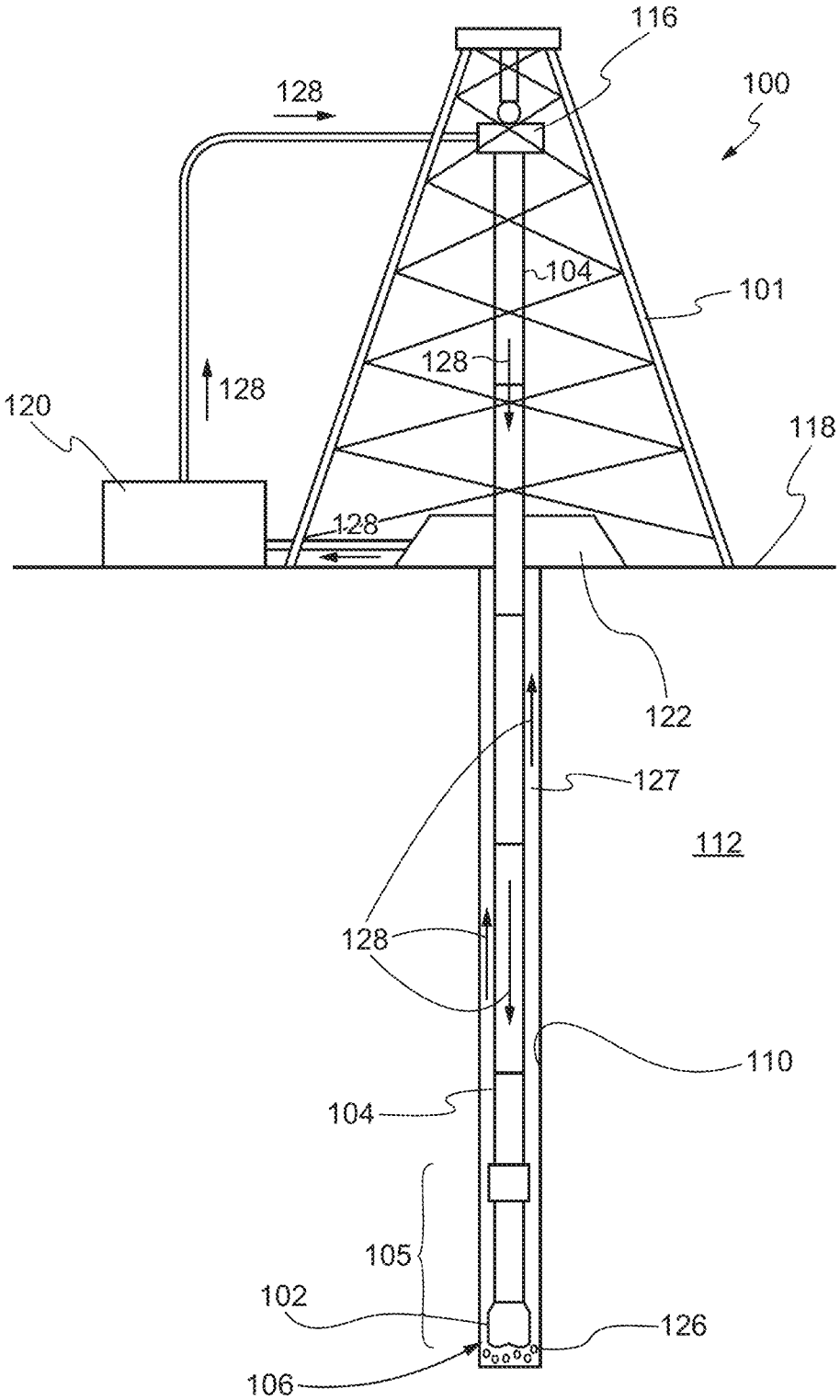
FIG. 1 is a schematic view of a downhole drilling operation in accordance with various embodiments.

Conventional downhole drilling operations utilize drilling fluid, such as drilling mud or a pneumatic fluid, to serve a number of critical downhole functions. For example, drilling fluid may be used to evacuate or "lift" the rock cuttings to the surface. During a drilling operation, the drilling fluid may be pumped down the drill string, into a central passageway formed in the center of the drill bit, and then out through openings, ports or nozzles formed in the face of the drill bit. The drilling fluid both cools the cutters and helps to remove and carry cuttings from between the blades to the surface.

There are a number of advantages and disadvantages to liquid drilling (e.g., drilling with drilling mud) and air drilling (e.g., drilling with pneumatic fluid) operations. For example, liquid drilling is useful for keeping formation water out of a drilled bore hole. Formation water is typically encountered when drilling to a subsurface target depth, and the hydrostatic pressure of the hydraulic fluid column in the annulus is sufficient to keep water from flowing out of the exposed rock formations in the borehole. Moreover, liquid drilling is useful for controlling high pore pressure typically encountered in oil, natural gas, and geothermal drilling operations. The heavier hydraulic fluid column in the annulus provides a high bottom hole pressure needed to balance (or overbalance) the high pore pressure from a deposit of a natural resource such as oil or gas. However, the heavier hydraulic fluid column can be disadvantageous because it increases the confining pressure on the rock bit cutting face, which slows the drilling penetration rate. Furthermore, the high pressure and velocity at which the hydraulic fluid is pumped into the drill string and through the drill bit may imposes stress and erosion on the drill bit and on individual cutters affixed to the bit head.

In contrast to liquid drilling, the earliest recognized advantage of air drilling is the ability to increase the drilling penetration rate. The lighter the fluid of the column in the annulus (with entrained rock cuttings), the lower the confining pressure on the rock bit cutting face. The lower confining pressure allows the rock cuttings from the drill bit to be removed more easily from the cutting face. Air drilling may also avoid formation damage, which is an important issue in fluid recovery, and avoid loss of circulation, which can result in a catastrophic sever of the drill string and bit. However, unlike conventional hydraulic fluids used in liquid drilling, the pneumatic fluids used in air drilling are compressible and are not as effective as hydraulic fluids at preventing excessive temperatures that could degrade the cutters. Furthermore, pneumatic fluids have been found to less effectively evacuate cuttings formed during drillings. As a result, operators typically run pneumatic fluids at higher flow rates (relative to hydraulic fluids) to compensate, which further contributes to cutter erosion. Specifically, previous attempts to apply PDC technology in air drilling environments have proven unsuccessful primarily due to excessively rapid erosion of the drill bit face and PDC cutters. Air drilling thus presents a unique set of problems and challenges for PDC bits, particular those made with matrix bodies.

U.S. Publication No. 2021/0180408 A1, the entirety of which is incorporated here by reference, discloses various embodiments directed to drill bits developed to allow a portion of the drilling fluid pumped into the drill string and through the drill bit to bypass the face of the bit head. As described, the drill bit includes a first opening (e.g., a primary opening), such as a port or nozzle, formed in at least one of the plurality of channels within the portion of the face of the bit head. The first opening is in fluidic communication with the central passageway through a first bypath. The first bypath travels from the central passageway in a direction towards the face of the bit head (e.g., substantially same direction of drilling) to the first opening in the face. Additionally, the '408 Publication describes that the bit head may include a second opening (e.g., an auxiliary opening), such as a port or nozzle, formed in a gauge portion in at least one of the channels of the drill bit. The second opening is in fluidic communication with the central passageway through a second bypath. The second bypath travels from the central passageway in a direction away from the face of the bit head (e.g., substantially opposite the direction of drilling) to the second opening in the gauge portion. Accordingly, drilling fluid pumped through the drill string and into the central passageway of the bit may partially flow through the second bypath and out of the second opening and partially flow through the first bypath and out the first opening. It has surprisingly and unexpectedly been found that the inclusion of auxiliary openings greatly reduces the stress and erosion imposed on the face of the drill bit as well as the PDC cutters formed thereon.

Before the disclosure of the '408 Publication, drill bits did not include the novel second bypaths or second openings. It has now been discovered that the benefits of the second bypaths and second openings described in the '408 Publication largely may be achieved by incorporating one or more third bypaths (also referred to herein as "shank bypaths") and one or more third openings in the shank of the drill bit. As used herein, the terms "third bypath" and "third opening" refer to bypaths and openings found in the shank or shank region of a drill bit. In this way, a conventional bit head (not having any second bypaths or second openings) may be secured to a shank having at least one third bypath and at least one third opening, and thereby achieve substantially the same benefit of having the bypaths and openings in the gauge section of the bit head itself, as described in the '408 Publication. The securing of the bit head to the shank may for example be through one or more of a threaded engagement, brazing, and/or welding.

In this context, it is noted that the terms "first," "second," and "third," are used solely to distinguish between the various bypaths and openings, and are not intended to convey any order or required combination of any of these features. In other words, the various embodiments of the disclosure optionally may include: (i) first and third bypaths/openings only (no second bypaths/openings in the gauge region of the drill bit), or, less likely, (ii) second and third bypaths/openings only (without a first bypaths/openings), or (iii) may include one or more first bypaths/openings, one or more second bypaths/openings, and one or more third bypaths/openings.

The drill bits described herein are suitable for a variety of downhole operations, including drilling (e.g., rotary drilling with a blade bit), mining, blast hole drilling, frac completion, refracturing, reentry, or remediation.

As used herein, the terms "substantially," "approximately" and "about" are defined as being largely but not necessarily wholly what is specified (and include wholly what is specified) as understood by one of ordinary skill in the art. In any disclosed embodiment, the term "substantially," "approximately," or "about" may be substituted with "within [a percentage] of" what is specified, where the percentage includes 0.1, 1, 5, and 10 percent.

As used herein, the term "fluidic communication" means that the components are connected to one another in a manner that allows a fluid (e.g., pneumatic or hydraulic fluid) to pass there between.

As used herein, when an action is "based on" something, this means the action is based at least in part on at least a part of the something.

Drilling Rig

As noted above, the present disclosure relates to a novel drill bit design for use in engaging subterranean formations and for drilling wellbores. The drill bits disclosed herein may be incorporated into a system for drilling and other downhole operation.

FIG. 1 is a schematic representation of a drilling rig 100 for a drilling operation. Each of the components that are shown in the schematic representation of the drilling rig 100 are intended to be generally representative of the component, and the particular example is intended to be a non-limiting, representative example of how a drilling rig might be set up for drilling with a drill bit as described herein. In various embodiments, the drilling rig 100 includes a derrick 101 that positions a drill bit 102 at the end of a drill string 104 within the hole or well bore 106 that is formed in the subterranean formation 112. During drilling operations, a drill bit 102 may be coupled to a lower end of the drill string 104. In some embodiments, the drill bit 102 comprises a bit head having one or more PDC cutters comprised of sintered polycrystalline diamond (either natural or synthetic) exhibiting diamond-to-diamond bonding, polycrystalline cubic boron nitride, wurtzite boron nitride, aggregated diamond nanorods (ADN), other hard crystalline materials that may be substituted for diamond, or combinations thereof.

Drill string 104 may be several miles long and, like the well bore 106, extend in both vertical and horizontal directions from the surface 118. In this example, the drill string 104 is formed of segments of threaded pipe that are screwed together at the surface as the drill string 104 is lowered into the well bore 106. However, the drill string 104 may also comprise coiled tubing. The drill string 104 may also include components other than pipe or tubing. For example, a bottom hole assembly (BHA) 105 may be coupled to a lower end of the drill string 104 prior to the drill bit 102. The BHA 105 may include, depending on the particular application, one or more of the following components: a bit sub, a downhole motor, stabilizers, drill collar, jarring devices, directional drilling and measuring equipment, measurements-while-drilling tools, logging-while-drilling tools and other devices. The characteristics of the components of the BHA 105 contribute to determining the drilling penetration rate of the drill bit 102 and the well bore 106 shape, direction and other geometric characteristics.

During drilling, the drill bit 102 is rotated to shear the subterranean formation 112 and advance the well bore 106. The drill bit 102 may be rotated in any number of ways. For example, the drill bit 102 may be rotated by rotating the drill string 104 with a top drive 116 or a rotary table (not shown) and/or with a downhole motor that is part of the BHA 105. The drill bit 102 may be surrounded by a sidewall 110 of the well bore 106. As the drill bit 102 is rotated within the well bore 106 via the drill string 104, a drilling fluid may be pumped down the drill string 104, through the internal passageways within the drill bit 102, and out from drill bit 102 through openings, nozzles or ports. Formation cuttings 126 generated by the one or more PDC cutters of the drill bit 102 may be carried with the drilling fluid through the channels, around the drill bit 102, and back up the well bore 106 through the annular space 127 within the well bore 106 outside the drill string 104.

The drilling fluid may be pumped down the drill string 104 using conventional means, e.g., pumps. FIG. 1 illustrates a fluid source 120, which is intended to be a non-limiting representation of the possible ways of pumping the drilling fluid (e.g., hydraulic or pneumatic fluid), as the drill bit 102 can be used with any of them. The drilling fluid is circulated down the well bore 106 by flowing it through the drill string 104, to the drill bit 102, where it exits through the openings, nozzles or ports to carry cuttings away from the face of the drill bit 102 and into the annular space 127, where the cuttings may be carried up to a collection point 122. The drilling fluid within the collection point 122 may be recirculated once cleaned of the cuttings.

In various embodiments, the drilling fluid comprises liquid drilling mud (i.e., a hydraulic fluid). Various conventional liquid drilling muds are known, and each of these is acceptable for use with the drill bits and the drilling system described herein. In some embodiments, for example, the liquid drilling mud may comprise water alone or in combination with other components. In some embodiments, the liquid drilling mud may comprise water in combination with clays (e.g., betonite) or other chemicals (e.g., potassium formate). In some embodiments, the liquid drilling mud may be an oil-based mixture, for example, comprising a petroleum product. In some embodiments, the liquid drilling mud may comprise a synthetic oil.

In various embodiments, the drilling fluid comprises a pneumatic fluid, e.g., a mixture of one or more gases. In some embodiments, the pneumatic fluid comprises atmospheric air (e.g., a combination of atmospheric gases). In other embodiments, the pneumatic fluid comprises one or more gases from storage tanks that is then vaporized to create high pressure gas, which may or may not be further compressed. In other embodiments, the pneumatic fluid is a combination of atmospheric gases (e.g., air) and additional gases such as inert gases, e.g., argon or helium. In some embodiments, the pneumatic fluid is pressurized before flowing through the drill pipe. The pressurized pneumatic fluid can be generated in any number of ways, any of which may be used with the drill bit 102. For example, the fluid source 120 may comprise one or more high pressure pumps that compresses the air.

Drill Bit

The present disclosure relates to a drill bit and in particular to a shank or shank region structurally modified to reduce erosion of the PDC cutters and/or the face of the bit head. In particular, the present disclosure relates to PDC drill bits having one or more openings (third openings) in the shank or shank region of the drill bit. This additional opening, as described in detail below, allows a portion of the drilling fluid to bypass the face of the bit head, thereby reducing the erosion of the PDC cutters and/or the face. The drill bit may optionally further include one or more openings (second openings) in the gauge region of the bit head of the drill bit, as described in the '408 Publication.

The drill bits of the present disclosure comprise a bit head and a shank, or in the case of an integrated drill bit, may comprise a bit head section and a shank section. In this context, the terms "bit" and "shank" shall be interpreted generically so as to cover separately formed components of the drill bit, or a bit head region and a shank region, respectively, of an integrated drill bit where both sections are formed together as a unitary structure. The shank comprises a shank body defining a longitudinally extending shank bore, where the shank body includes at least one shank bypath extending from the shank bore to a shank outer surface. The bit head is optionally connected to, e.g., threaded with, brazed to, and/or welded to, the shank. The bit head comprises a bit body comprising a gauge for engaging a side of a well bore and a face for engaging a bottom of the well bore. The bit head further comprises a plurality of channels extending radially along a portion of the face and extend longitudinally along a portion of the gauge. In this context, the term "radial" should be understood as extending in a generally radial direction and includes channels that may have a curve to them or may have a helical arrangement. The bit head further comprises a central pathway formed through the body and in fluid communication with the shank bore for providing a fluid to the plurality of channels through at least one first opening. At least one of the plurality of blades comprises an edge on which is mounted a plurality of cutters arranged for shearing the bottom of the well bore. As indicated above, in some optional embodiments, the drill bit, e.g., the bit head thereof, optionally includes a second opening in fluidic communication with the central pathway through an optional second bypath (also referred to herein as a "bit bypath"). In this aspect, the optional second opening is preferably situated in the gauge of the bit head.

Figure 2A:
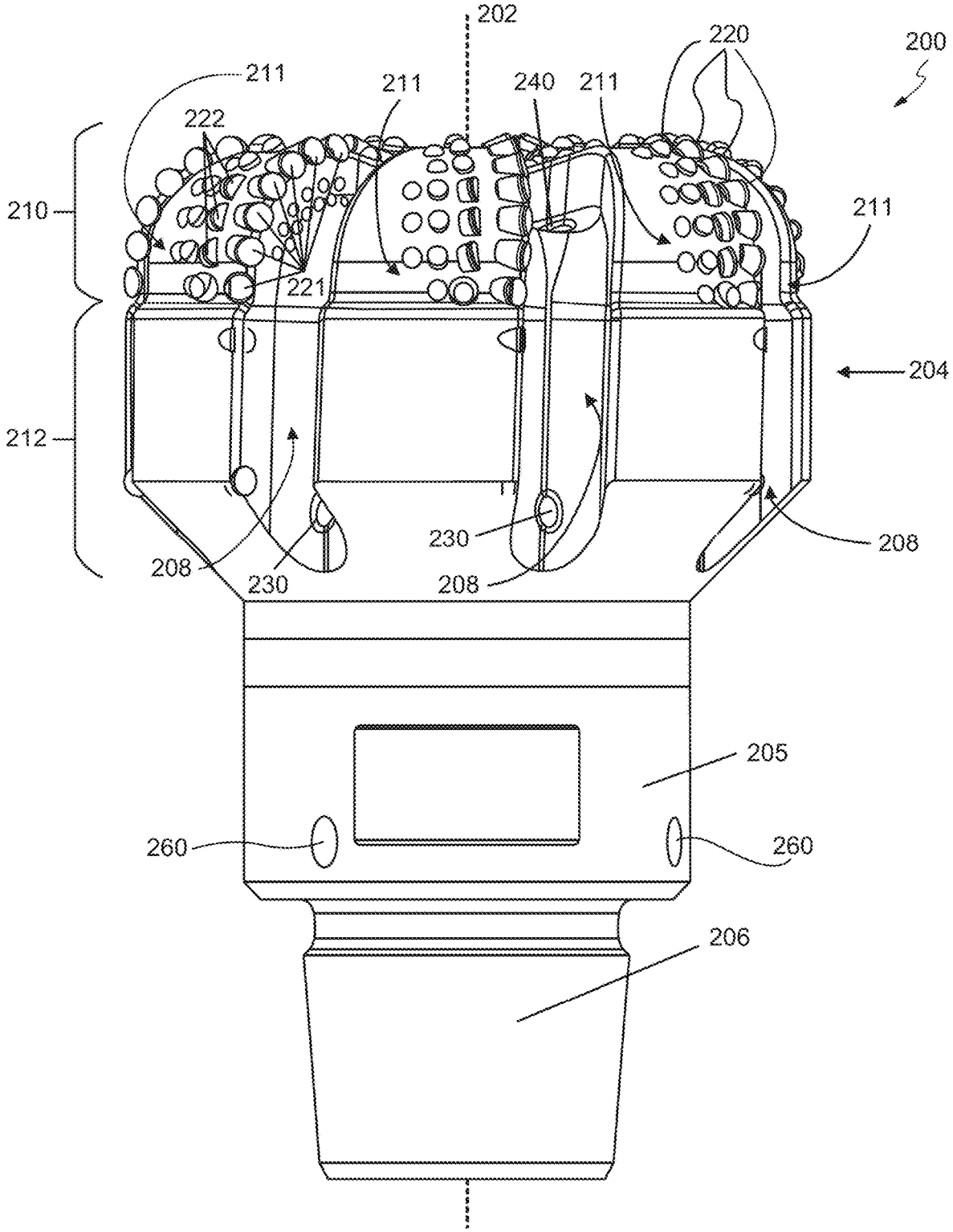
FIG. 2A is a side view of a drill bit in accordance with various embodiments of the present disclosure.
Figure 2B:
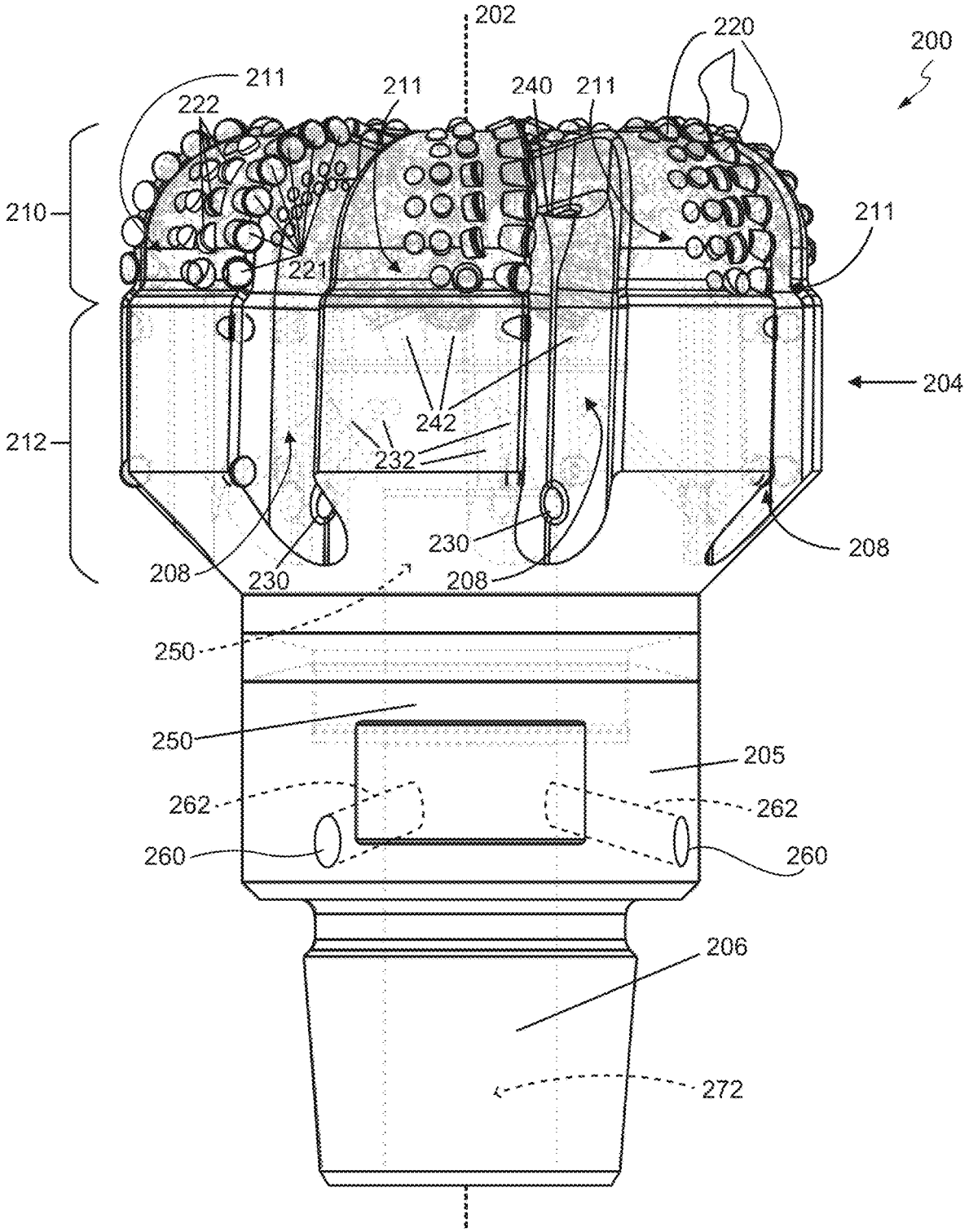
FIG. 2B is a side view of a drill bit in accordance with various embodiments of the present disclosure, wherein internal features of the drill bit are depicted with dashed lines.

FIGS. 2A and 2B illustrate an embodiment of one drill bit according to the present disclosure. In particular, FIGS. 2A and 2B illustrate a drill bit 200 (e.g., the drill bit 104 as described with respect to FIG. 1) structurally adapted to reduce erosion of the face. The drill bit 200 is intended to be a representative example of drill bits, e.g., PDC drag bits, for drilling of subterranean formations. The drill bit 200 is designed structurally and mechanically to be rotated around its central axis 202. As shown, the drill bit 200 comprises a bit head 204 connected to a shank 205 having a tapered threaded coupling 206 for connecting the drill bit 200 to a drill string (not shown in FIG. 2A or FIG. 2B but as described with respect to FIG. 1). The bit head 204 is not limited to any particular material. In some embodiments, the bit head 204 is made from an abrasion-resistant composite material or "matrix" comprising, for example, powdered tungsten carbide cemented by metal binder.

As shown, the bit head 204 is disposed radially around the central axis 202, about which the bit head 204 is intended to rotate during the drilling process. As shown in FIGS. 2A and 2B, the bit head 204 includes a face 210 that is intended to engage a bottom end of the well bore being drilled. In the embodiment shown in the figures, the face 210 substantially lies in a plane perpendicular to the central axis 202 of the drill bit 200. The bit head 204 also includes a gauge 212 that is intended to engage a side wall of the well bore being drilled. In the embodiment shown in the figures, the gauge 212 substantially lies in a plane parallel to the central axis 202 of the drill bit 200. The drill bit 200 further includes a plurality of channels 208 formed in the bit head 204, extending along a portion of the face 210 and along a portion of the gauge 212. Formed between the channels 208 are a plurality of blades 211.

In the drill bit 200, the cutting elements 220 may be placed along the forward (in the direction of intended rotation) side of the blades 211, with their working surfaces facing generally in the forward direction for shearing the subterranean formations when the drill bit 200 is rotated about its central axis 202. In some embodiments, one or more blades 211 may comprise one or more rows of cutting elements 220 disposed thereon. In some embodiments, the PDC drill bit 200 has both a first row of PDC cutters 221 (i.e., a subset of the cutting elements 220) and a second row of PDC cutters 222 (i.e., another subset of the cutting elements 220) mounted on each of the blades 211. The first row of PDC cutters 221 may be primary cutters and the second row of PDC cutters may be secondary or backup cutters. Furthermore, the primary cutters may be single set or a plural set.

First Opening

The drill bits of the present disclosure preferably include a first opening (e.g., a primary opening), located within the portion of the face of at least one of the plurality of channels. In this location, the first opening, and the first bypath to which it connects, provides a pathway for drilling fluid such that the drilling fluid can reach the face of the bit head. The drilling fluid can therefore be used to serve, e.g., cool, the cutters formed on the face of the drill and to help remove and carry away rock cuttings from between the blades. In the embodiment shown in FIGS. 2A and 2B, for example, drill bit 200 includes first openings 240 formed in the face 210. As can be seen in FIG. 2B, in particular, the drill bit comprises: (i) a bit head 204 having a central pathway 250, which runs therethrough, and (ii) a shank 205 having a shank bore 272, which runs therethrough. The central pathway 250 is in fluid communication with and preferably is coaxially aligned with shank bore 272. The central pathway 250 is connected to each first opening 240 via first bypath 242. The central pathway 250, in part through the first bypath 242, is intended to provide drilling fluid to the channels 208.

In some embodiments, the drill bit comprises one first opening. In other embodiments, the drill bit may comprise at least one first opening, e.g., at least two first openings, at least three first openings, four first openings, or at least five first openings. In some embodiments, the number of first openings corresponds to the number of auxiliary openings, e.g., one first opening for each auxiliary opening, two first openings for each auxiliary opening, or one first opening for each two auxiliary openings. In the embodiment shown in FIGS. 2A and 2B, for example, drill bit 200 includes one first opening 240 formed in a portion of the face 210 of each channel 208.

In some embodiments, the drill bit comprises a first opening in each channel of the plurality of channels. In one such embodiment, for example, the drill bit comprises four channels formed in the body of the drill bit, and each of the four channels comprises a first opening. In some of these embodiments, each channel of the plurality may comprise one first opening. In some of these embodiments, each channel of the plurality of channels may comprise at least one first opening, e.g., at least two first openings, at least three first openings, four first openings, or at least five first openings. In some embodiments, the drill bit comprises a first opening in each channel in which a second opening (discussed below) is formed.

The nature and structure of the first opening is not particularly limited. In some embodiments, the first opening comprises a port. In some embodiments, the first opening comprises a nozzle. In some embodiments, the drill bit comprises a plurality of first openings, and each first opening comprises a port. In some embodiments, the drill bit comprises a plurality of first openings, and each first opening comprises a nozzle. In some embodiments wherein the drill bit comprises a plurality of first openings, each first opening may independently comprise a port or a nozzle. In the embodiment shown in FIGS. 2A and 2B, for example, the drill bit 200 includes a first opening 240 formed in a portion of the face 210 of each channel 208, and each first opening 240 is formed in a nozzle.

Figure 3:
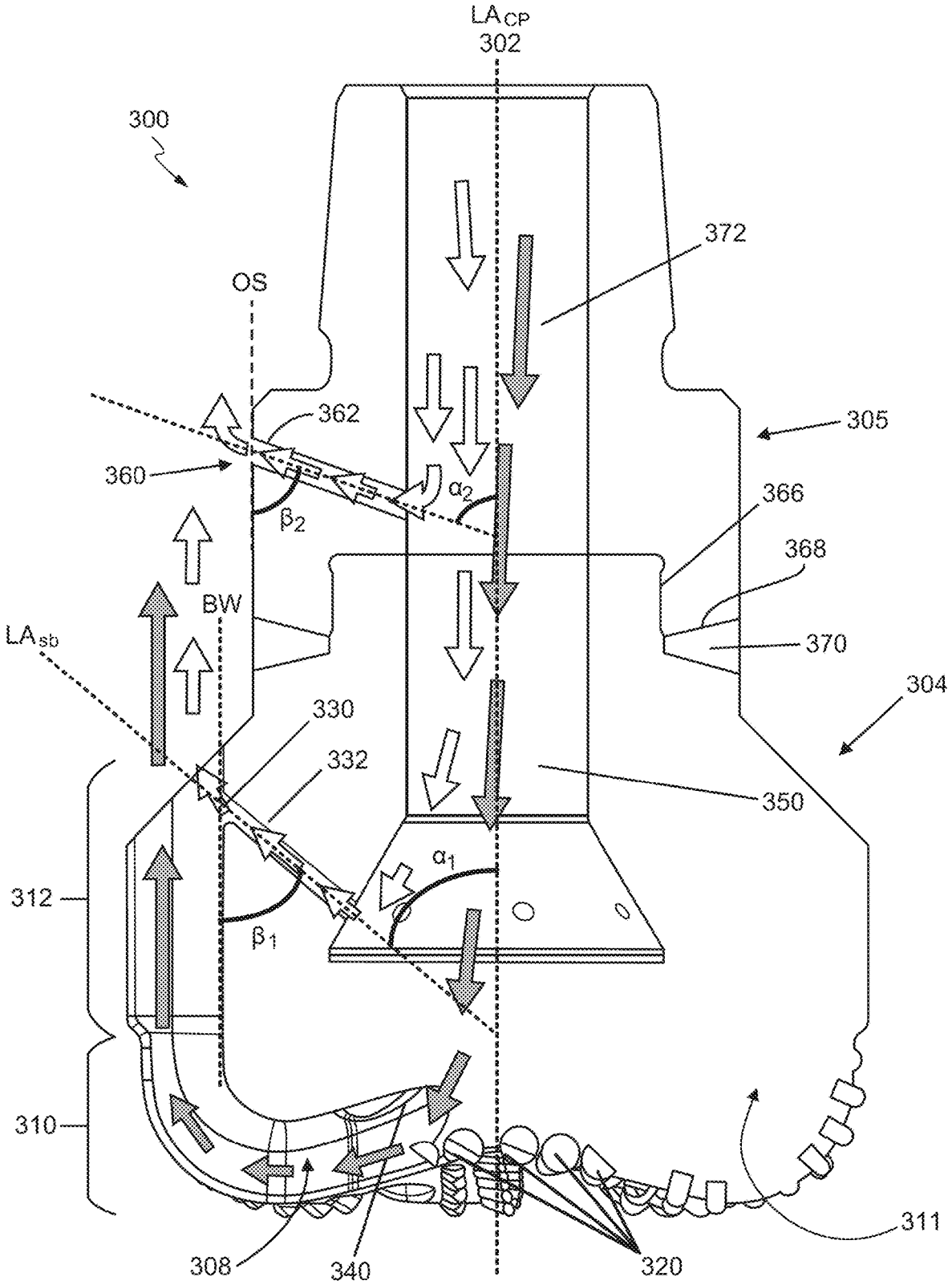
FIG. 3 is a cross-sectional view of a drill bit having a uphole shank bypath in accordance with various embodiments of the present disclosure.

FIG. 3 also depicts the first opening 340. As shown, the central pathway 350 is also connected to a first opening 340 via a first bypath (not illustrated). The first bypath is directed toward the face 310. During drilling, the first bypath is directed toward the direction of drilling and allows the flow of drilling fluid (illustrated by arrows) to the face 310 through the first opening 340.

Second Opening

As discussed above, although the present disclosure focuses on the third openings and third bypaths (shank bypaths) in the shank or shank region of the drilling assembly, in some optional embodiments, the drill bit further comprises one or more second openings in the gauge of the bit head of the drill bit, as described in the '408 Publication. In other embodiments, the drill bit and the bit head thereof does not include any second openings or any second bypaths. Thus, the bit head in the drill bit of the present disclosure optionally include a second opening (e.g., an auxiliary opening) located within the portion of the gauge of at least one of the plurality of channels. In this location, the second opening, and the second bypath to which it connects, provides a pathway for drilling fluid such that the drilling fluid can bypass the face of the bit head. In the embodiments shown in FIGS. 2A and 2B, the drill bit 200 includes a bit head 204 having second openings 230 formed in the gauge 212. As can be seen in FIG. 2B, in particular, the bit head 204 comprises a central pathway 250, which runs through bit head 204. The central pathway 250 is connected to each second opening 230 via a second bypath 232. The central pathway 250, through the second bypath 232 and the first bypath 242, is intended to provide drilling fluid to the channels 208.

In some embodiments, the bit head of the drill bit comprises one second opening. In other embodiments, the bit head may comprise a plurality of second openings. For example, the bit head may comprise at least one second opening, e.g., at least two second openings, at least three second openings, at least four second openings, or at least five second openings.

In some embodiments, the drill bit comprises a bit head or bit head region comprising a second opening in each channel of the plurality of channels. In one such embodiment, for example, the bit head comprise four channels formed in the body of the bit head, and each of the four channels comprises a second opening formed in a portion of the gauge. In some of these embodiments, each channel of the plurality may comprise one second opening. In some of these embodiments, each channel of the plurality of channels may comprise at least one second opening, e.g., at least two second openings, at least three second openings, at least four second openings, or at least five second openings. In the embodiment shown in FIGS. 2A and 2B, for example, the drill bit 200 includes a bit head 204 comprising one second opening 230 formed in each channel.

The nature and structure of the second openings are not particularly limited. In some embodiments, the second opening is a port. In some embodiments, the second opening comprises a nozzle. In some embodiments, the bit head comprises a plurality of second openings, and each second opening is a port. In some embodiments, the bit head comprises a plurality of second openings, and each second opening comprises a nozzle. If the second opening comprises a nozzle, the nozzle could be brazed or threaded to the bit head and may be formed, for example, of steel, tungsten carbide, or similar material. In some embodiments, the bit head comprises a plurality of second openings, each second opening independently comprising a port and/or a nozzle. In the embodiments shown in FIGS. 2A and 2B, for example, each second opening 230 comprises a port.

In the bit heads of the present disclosure, the second opening is in communication with the central pathway of the bit head through a second bypath. Each of the second bypath and the central pathway optionally has a longitudinal axis, which runs through the center of the second bypath and the central pathway, respectively. Similarly, the second opening may be located on the bottom wall of the gauge portion of a channel, and the bottom wall may comprise a longitudinally extending surface. The second bypath, central pathway, and/or the bottom wall of the channel are preferably structured such that the second bypath is generally directed toward the gauge and substantially away from the face of the bit head.

In some embodiments, for example, the second bypath and central pathway may be structured such that the longitudinal axis of the second bypath and the longitudinal axis of the central pathway intersect at a specific angle ($\alpha_1$). In one embodiment, the angle of intersection between the longitudinal axis of the second bypath and the longitudinal axis of the central pathway is less than 90 degrees, e.g., less than 80 degrees, less than 70 degrees, or less than 60 degrees. In terms of lower limits, the angle of intersection between the longitudinal axes may be greater than 0 degrees, e.g., greater than 5 degrees, greater than 10 degrees, greater than 15 degrees, or greater than 20 degrees. In terms of ranges, the angle of intersection between the longitudinal axes may be from 0 to 90 degrees, e.g., from 10 to 80 degrees, from 20 to 70 degrees, or from 30 to 60 degrees. In some embodiments, the angle of intersection between the longitudinal axis of the second bypath and the longitudinal axis of the central pathway is about 90 degrees. In some embodiments, the angle of intersection between the longitudinal axes may be greater than 90 degrees, e.g., greater than 100 degrees, greater than 110 degrees, or greater than 120 degrees. For example, the second bypath optionally extends at a downhole angle $\alpha_1$ relative to the longitudinal axis, e.g., at a downhole angle $\alpha_1$ greater than 90° and less than 135°, or at a downhole angle $\alpha_1$ from 100° to 130°. For embodiments having a non-linear, e.g., curved, second bypath, the longitudinal axis of the second bypath is determined at a tangent line where the second bypath intersects the longitudinal axis of the central pathway.

In some embodiments, for example, the second bypath and bottom wall may be structured such that the longitudinal axis of the second bypath and the longitudinally extending surface of the bottom wall intersect at a specific angle ($\beta_1$). In one embodiment, the angle of intersection between the longitudinal axis of the second bypath and the longitudinally extending surface of the bottom wall is less than 90 degrees, e.g., less than 80 degrees, less than 70 degrees, or less than 60 degrees. In terms of lower limits, the angle of intersection between the longitudinal axis of the second bypath and the longitudinally extending surface of the bottom wall may be greater than 0 degrees, e.g., greater than 5 degrees, greater than 10 degrees, greater than 15 degrees, or greater than 20 degrees. In terms of ranges, the angle of intersection between the longitudinal axis of the second bypath and the longitudinally extending surface of the bottom wall may be from 0 to 90 degrees, e.g., from 10 to 80 degrees, from 20 to 70 degrees, or from 30 to 60 degrees. In some embodiments, the angle of intersection between the longitudinal axis of the second bypath and the longitudinally extending surface of the bottom wall is about 90 degrees. In some embodiments, the angle of intersection between the longitudinal axis of the second bypath and the longitudinally extending surface of the bottom wall is greater than 90 degrees, e.g., greater than 100 degrees, greater than 110 degrees, or greater than 120 degrees. For example, the second bypath optionally extends at a downhole angle $\beta_1$, e.g., at a downhole angle $\beta_1$ greater than 90° and less than 135°, or at a downhole angle $\beta_1$ from 100° to 130°. For embodiments having a non-linear, e.g., curved, second bypath, the longitudinal axis of the second bypath is determined at a tangent line where the second bypath intersects the longitudinally extending surface of the bottom wall.

The shape of the second bypath is not particularly limited, and any suitable shape may be utilized. In some embodiments, the second bypath is substantially straight and thus has a longitudinal axis along its entire length. In some embodiments, the second bypath is curved. In some embodiments, the second bypath has a cross-section that is selected from the group consisting of circular, substantially circular, crenulated, ovular, substantially ovular, polygonal, substantially polygonal, dog-bone, "Y," "X," "K," "C," multi-lobe, and any combination thereof.

Optional structure and orientation of the second bypath can be seen in FIG. 3, which depicts the cross-section of an embodiment of the drill bit of the present disclosure. As shown, drill bit 300 comprises a bit head 304 and a shank 305, both disposed radially around central axis 302, about which the drill bit 300 is intended to rotate during the drilling process. In the embodiment shown, bit head 304 is threadedly engaged with shank 305 at a threaded interface 366 between the two portions of the drill bit 300. Additionally, as shown, a weld 370 formed within a weld groove 368 secures bit head 304 to the shank 305. Other attachment means known in the art are also possible. The bit head 304 includes a face 310 that is intended to engage a bottom end of the well bore being drilled and a gauge 312 that is intended to engage side wall of the well bore being drilled. FIG. 3 depicts the cross-section of one channel 308 formed in the bit head 304, extending along a portion of the face 310 and along a portion of the gauge 312, as well as depicts the cross-section of one blade 311. The drill bit 300 also includes cutting elements 320 for shearing the subterranean formations when the drill bit 300 is rotated about its central axis 302

As can be seen in FIG. 3, the bit head 304 comprises a central pathway 350, which runs through the body of bit head 304. The central pathway 350 is connected to a second opening 330 via a second bypath 332. The central pathway 350, in part through the second bypath 332 and the first bypath, is intended to provide drilling fluid to the channels 308.

In FIG. 3, arrows illustrate the typical direction of drilling fluid flow during operation. The arrows demonstrate how the second bypath 332 is structured to allow the drilling fluid to bypass the face of the bit. As shown, the second bypath 332 is directed toward the gauge 312. During drilling, the second bypath 332 is optionally directed opposite (uphole direction) the direction of drilling, although in other configurations the second bypath may be directed in the direction of drilling, or at about a 90° angle (normal to the direction of drilling). In particular, the second bypath is structured such that the longitudinal axis $LA_{sb}$ of the second bypath 332 intersects with the longitudinal axis $LA_{cp}$ of the central pathway (which corresponds to the central axis 302 in this embodiment) at an angle $\alpha_1$, which may be less than 90 degrees (as shown), at about 90 degrees, or greater than 90 degrees. The angle $\alpha_1$ shown in FIG. 3 is in an uphole direction. Furthermore, the second bypath is structured such that the longitudinal axis $LA_{sb}$ of the second bypath 332 intersects with the bottom wall BW of the channel 308 at an angle $\beta_1$, which may be less than 90 degrees (as shown), at about 90 degrees, or greater than 90 degrees. The angle $\beta_1$ shown in FIG. 3 is about 45° in an uphole direction.

Third Opening

The drill bits of the present disclosure include a shank (or shank region) having one or more third openings therein and preferably one or more third bypaths extending from the shank bore to the one or more third openings. Thus, the third opening, and the third bypath to which it connects, provides a pathway for drilling fluid such that the drilling fluid can bypass the face of the bit head. In the embodiments shown in FIGS. 2A and 2B, the shank 205 includes third openings 260 formed at the outer surface thereof. As can be seen in FIG. 2B, in particular, the shank 205 comprises a shank bore 372, which runs therethrough, and which is in fluidic communication with the central pathway 350 of bit head 304. The shank bore 372 is connected to each third opening 260 via a third bypath 262.

Thus, the shank of the drill bit comprises at least one third opening. In other embodiments, the shank may comprise a plurality of third openings. For example, the shank may comprise at least one third opening, e.g., at least two third openings, at least three third openings, at least four third openings, or at least five third openings.

In some embodiments, the drill bit comprises a shank or shank region comprising one or more third openings aligned with one or more respective channels of the plurality of channels in the bit head or bit head section of the drill bit. In one such embodiment, for example, the bit head comprises four channels formed in the body of the bit head, and each of the four channels is aligned with a respective third opening in the shank or shank region. In some of these embodiments, each channel of the plurality of channels may be aligned with one third opening in the shank or shank region. Each channel of the plurality of channels optionally may be aligned with at least one third opening, e.g., at least two third openings, at least three third openings, at least four third openings, or at least five third openings. In the embodiment shown in FIGS. 2A and 2B, for example, the drill bit 200 includes third openings 260, which are aligned with (e.g., immediately uphole of) two of the channels of the bit head. Additionally or alternatively, the one or more third openings may be aligned with the blades of the bit head rather than with the channels of the bit head.

The nature and structure of the third openings are not particularly limited. In some embodiments, the third opening is a port. In some embodiments, the third opening comprises a nozzle. In some embodiments, the shank comprises a plurality of third openings, and each third opening is a port. In some embodiments, the shank comprises a plurality of third openings, and each third opening comprises a nozzle. If the third opening comprises a nozzle, the nozzle could be brazed or threaded to the shank and may be formed, for example, of steel, tungsten carbide, or similar material. In some embodiments, the shank comprises a plurality of third openings, each third opening independently comprising a port and/or a nozzle. In the embodiments shown in FIGS. 2A and 2B, for example, each third opening 230 comprises a port.

In the shanks of the present disclosure, the third opening is in communication with the shank bore through a third bypath. Each of the third bypath and the shank bore optionally has a longitudinal axis, which runs through the center of the third bypath and the shank bore, respectively. The third opening is preferably located on a longitudinally extending outer surface of the shank. The third bypath, shank bore, and/or the outer surface are preferably structured such that the third bypath is generally directed substantially away from the face of the bit head.

In some embodiments, for example, the third bypath and shank bore may be structured such that the longitudinal axis of the third bypath and the longitudinal axis of the shank bore intersect at a specific angle ($\alpha_2$). In one embodiment, the angle of intersection between the longitudinal axis of the third bypath and the longitudinal axis of the shank bore is less than 90 degrees, e.g., less than 80 degrees, less than 70 degrees, or less than 60 degrees. In terms of lower limits, the angle of intersection between the longitudinal axes may be greater than 0 degrees, e.g., greater than 5 degrees, greater than 10 degrees, greater than 15 degrees, or greater than 20 degrees. In terms of ranges, the angle of intersection between the longitudinal axes may be from 0 to 90 degrees, e.g., from 10 to 80 degrees, from 20 to 70 degrees, from 30 to 60 degrees, or from 45 to 60 degrees. In some embodiments, the angle of intersection between the longitudinal axis of the third bypath and the longitudinal axis of the shank bore is about 90 degrees. In some embodiments, the angle of intersection between the longitudinal axis of the third bypath and the longitudinally axis of the shank bore is greater than 90 degrees, e.g., greater than 100 degrees, greater than 110 degrees, or greater than 120 degrees. For example, the shank bypath optionally extends from the shank bore to the shank outer surface at a downhole angle $\alpha_2$ relative to the longitudinal axis, e.g., at a downhole angle $\alpha_2$ greater than 90° and less than 135°, or at a downhole angle $\alpha_2$ from 100° to 130°.

For embodiments having a non-linear, e.g., curved, third bypath, the longitudinal axis of the third bypath is determined at a tangent line where the third bypath intersects the longitudinal axis of the shank bore.

In some embodiments, for example, the third bypath and the longitudinally extending outer surface of the shank may be structured such that the longitudinal axis of the third bypath and the outer surface intersect at a specific angle ($\beta_2$). Notably, the relative angles $\alpha_2$ and $\beta_2$ may be the same or different from one another. In one embodiment, the angle of intersection between the longitudinal axis of the third bypath and the outer surface of the shank is less than 90 degrees, e.g., less than 80 degrees, less than 70 degrees, or less than 60 degrees. In terms of lower limits, the angle of intersection between the longitudinal axis of the third bypath and the outer surface may be greater than 0 degrees, e.g., greater than 5 degrees, greater than 10 degrees, greater than 15 degrees, or greater than 20 degrees. In terms of ranges, the angle of intersection between the longitudinal axis of the third bypath and the outer surface of the shank may be from 0 to 90 degrees, e.g., from 10 to 80 degrees, from 20 to 70 degrees, from 30 to 60 degrees, or from 45 to 60 degrees. In some embodiments, the angle of intersection between the longitudinal axis of the third bypath and the outer surface of the shank is about 90 degrees. In some embodiments, the angle of intersection between the longitudinal axis of the third bypath and the outer surface of the shank is greater than 90 degrees, e.g., greater than 100 degrees, greater than 110 degrees, or greater than 120 degrees. For example, the shank bypath optionally extends from the shank bore to the shank outer surface at a downhole angle $\beta_2$ relative to the longitudinal axis, e.g., at a downhole angle $\beta_2$ greater than 90° and less than 135°, or at a downhole angle $\beta_2$ from 100° to 130°. For embodiments having a non-linear, e.g., curved, third bypath, the longitudinal axis of the third bypath is determined at a tangent line where the third bypath intersects the outer surface of the shank.

The shape of the third bypath is not particularly limited, and any suitable shape may be utilized. In some embodiments, the third bypath is substantially straight and thus has a longitudinal axis along its entire length. In some embodiments, the third bypath is curved. In some embodiments, the third bypath has a cross-section that is selected from the group consisting of circular, substantially circular, crenulated, ovular, substantially ovular, polygonal, substantially polygonal, dog-bone, "Y," "X," "K," "C," multi-lobe, and any combination thereof.

The structure and orientation of the third bypath can be seen in FIG. 3, which depicts the cross-section of an embodiment of the drill bit of the present disclosure. As shown, the shank bore 372 is connected to a third opening 360 via a third bypath 362. The shank bore 372, in part through the third bypath 362, the central pathway 350, and the first bypath (not shown), is intended to provide drilling fluid to a region that is uphole of the channels 308.

In FIG. 3, arrows illustrate the typical direction of drilling fluid flow during operation. The arrows demonstrate how the third bypath 362 is structured to allow the drilling fluid to bypass the face of the bit. The third bypath 362 is directed toward a longitudinally extending outer surface 364 of shank 305. During drilling, in the embodiment shown, the third bypath 362 is directed in an uphole direction relative to the direction of drilling, although in other configurations the third bypath may be directed in the direction of drilling (downhole direction) or at about a 90° angle. In particular, as shown, the third bypath is structured such that the longitudinal axis $LA_{tb}$ of the third bypath 362 intersects with the longitudinal axis $LA_{cp}$ of the central pathway (which corresponds to the longitudinal axis of shank bore 372) at an angle @2, which is less than 90 degrees (although a 90° angle or angles greater than 90° are also contemplated). The angle $\alpha_2$ shown in FIG. 3 is directed in an uphole direction. Furthermore, the third bypath is structured such that the longitudinal axis $LA_{tb}$ of the third bypath 362 intersects with the outer surface (OS) 364 of shank 305 at an angle $\beta_2$, which as shown is less than 90 degrees (uphole direction), although a 90° angle or angles greater than 90° (downhole direction) are also contemplated.

Figure 4:
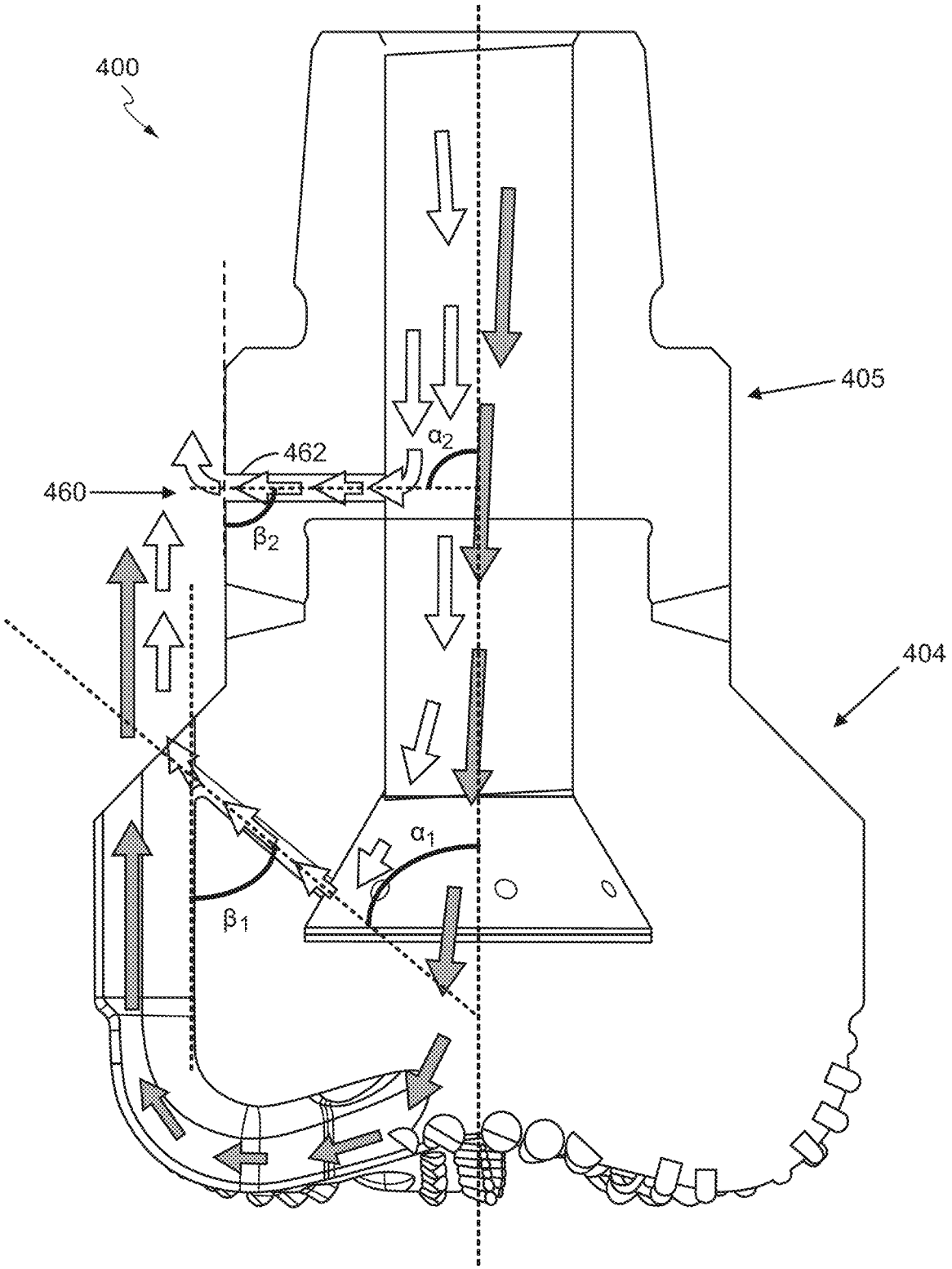
FIG. 4 is a cross-sectional view of a drill bit having a 90° shank bypath in accordance with various embodiments of the present disclosure.
Figure 5:
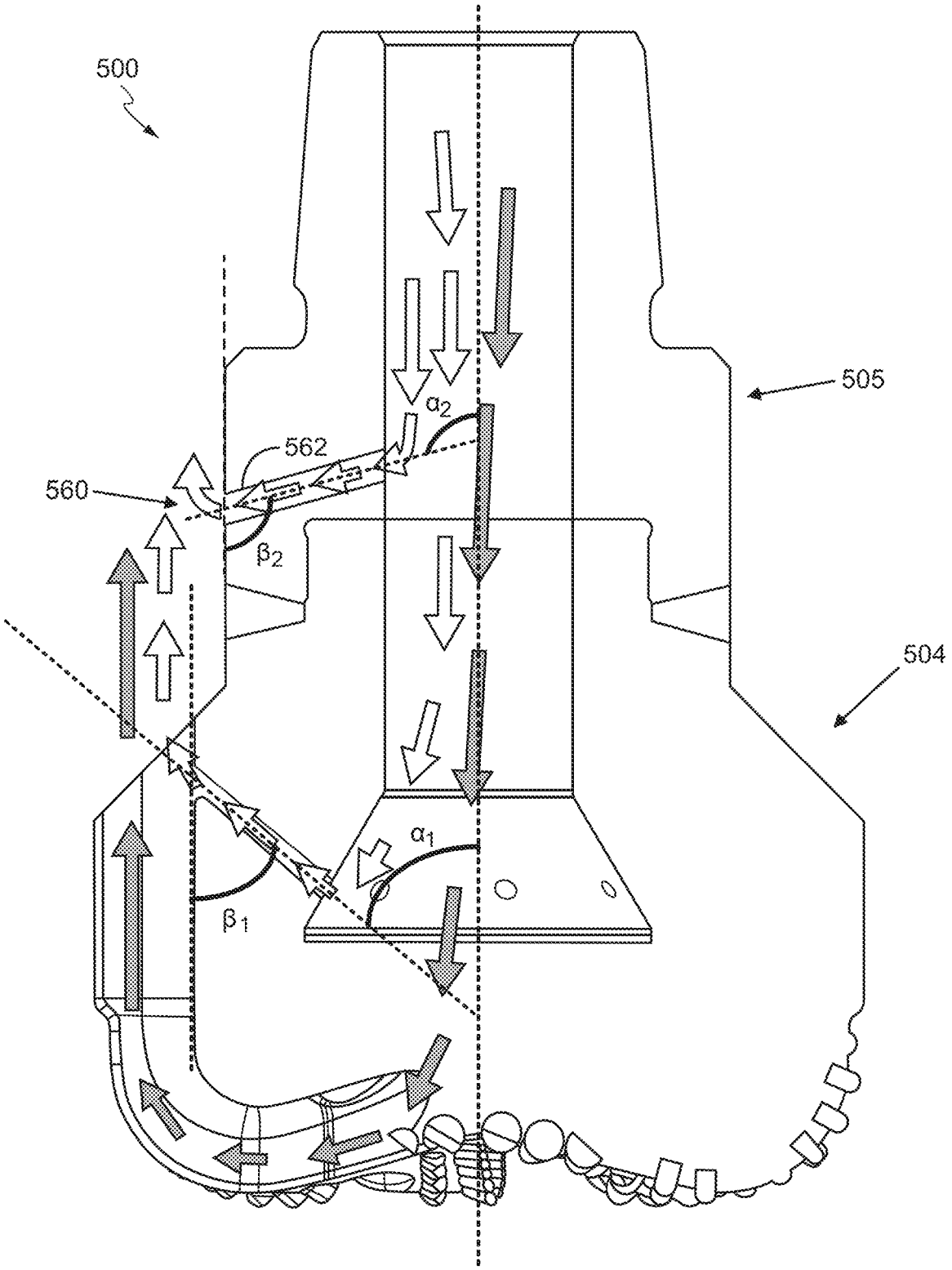
FIG. 5 is a cross-sectional view of a drill bit having a downhole shank bypath in accordance with various embodiments of the present disclosure.

The drill bit 400 shown in FIG. 4 is similar to the drill bit shown in FIG. 3 and comprises a bit head 404 and a shank 405, but drill bit 400 in FIG. 4 has a third opening 460 and a third bypath 462 having a third bypath angle $\alpha_2$ of about 90°. The drill bit 500 shown in FIG. 5 is also similar to the drill bit shown in FIG. 3 and comprises a bit head 504 and a shank 505. But drill bit 500 comprises a third opening 560 and a third bypath 562 having a downhole third bypath angle $\alpha_2$ of about 110°.

In some embodiments, the first bypath, the second bypath, and/or the third bypath are sized or otherwise designed to control the relative volume of drilling fluid that flows through each. In some embodiments, for example, the first bypath and the third bypath (and/or optional second bypath) are sized such that a greater volume of drilling fluid flows through the first bypath than through the third bypath (or second bypath). That is, during operation, the first bypath may provide a first volume of fluid (e.g., the bit face flow area), the third bypath may provide a third volume of fluid, and in some embodiments, the first volume of fluid is greater than the third volume of fluid. In one embodiment, the ratio of the first volume to the third volume is greater than 1, e.g., greater than 1.5, greater than 2, greater than 2.5, greater than 3, or greater than 3.5. Similarly, if the bit head of the drill bit includes a second bypath, then during operation, the first bypath may provide a first volume of fluid (e.g., the bit face flow area), the second bypath may provide a second volume of fluid, and in some embodiments, the first volume of fluid is greater than the second volume of fluid. In one embodiment, the ratio of the first volume to the second volume is greater than 1, e.g., greater than 1.5, greater than 2, greater than 2.5, greater than 3, or greater than 3.5.

In some embodiments, the third bypath (and/or optional second bypath) has a substantially constant diameter or width along its entire length. In other aspects, the diameter or width may increase or decrease as the third bypath (and/or optional second bypath) extends from the shank bore to the outer surface of the shank (or from the central pathway to the gauge of the bit for the second bypath). Although the actual diameter or width of the third bypath (and/or optional second bypath) may vary widely, in some optional embodiments, the third bypath (and/or optional second bypath) has an average diameter or width ranging from ⅛ to 1 inch (0.32 to 2.54 cm), e.g., from ¼ to ¾ inch (0.64 to 1.90 cm), or about ½ inch (1.27 cm).

In some aspects, the third bypath extends radially from the shank bore to the shank outer surface. In other aspects, the third bypath extends at a non-radial angle, optionally at a secant angle, from the shank bore to the shank outer surface. In another aspect, the third bypath extends substantially tangentially from the surface defining the shank bore to the shank outer surface. In this aspect, the tangential nature of the third bypath can cause the drilling fluid to create a vortex as it exits the third opening and flows up the bore hole, facilitating upflow of the drill fluid.

Channels

In various embodiments, the width, the depth, or a combination thereof (width and depth) of one or more channels of the plurality of channels of the bit head is substantially constant within at least a portion of the one or more channels of the plurality of channels. As described herein, the term "substantially" may be substituted with "within [a percentage] of" what is specified, where the percentage includes 0.1, 1, 5, and 10 percent; and thus "substantially constant" means that the width, the depth, or a combination thereof of the one or more channels remains within 0.1, 1, 5, or 10% throughout the portion of the channels (e.g., the width and/or depth never vary by more than 0.1, 1, 5, or 10% throughout the portion of the channels). In some embodiments, the width, the depth, or a combination thereof of each of the one or more channels is the same or different within the portion of the one or more channels where the width, the depth, or a combination thereof are maintained substantially constant. For example, a first subset of the one or more channels may have a first width, first depth, or combination thereof that remains substantially constant within at least a portion of the first subset of the one or more channels, and a second subset of the one or more channels may have a second width, second depth, or combination thereof that remains substantially constant within at least a portion of the second subset of the one or more channels, where the first width is the same or different as the second width, the first depth is the same or different as the second depth, or a combination thereof. In some embodiments, the width or the depth is substantially constant within at least a portion of the one or more channels of the plurality of channels. In other embodiments, the width and the depth are substantially constant within at least a portion of the one or more channels of the plurality of channels.

In various embodiments, the cross-sectional area of the one or more channels of the plurality of channels is substantially constant within at least a portion of the one or more channels of the plurality of channels. As described herein, the term "substantially" may be substituted with "within [a percentage] of" what is specified, where the percentage includes 0.1, 1, 5, and 10 percent; and thus "substantially constant" means that the cross-sectional area of the one or more channels remains within 0.1, 1, 5, or 10% through-out the portion of the channels (e.g., the cross-sectional area never vary by more than 0.1, 1, 5, or 10% through-out the portion of the channels). In some embodiments, the cross-sectional area of each of the one or more channels is the same or different within the portion of the one or more channels where the cross-sectional area is maintained substantially constant. For example, a first subset of the one or more channels may have a first cross-sectional area that remains substantially constant within at least a portion of the first subset of the one or more channels, and a second subset of the one or more channels may have a second cross-sectional area that remains substantially constant within at least a portion of the second subset of the one or more channels, where the first cross-sectional area is the same or different as the second cross-sectional area.

Reduced Erosion

As discussed, the present inventors have found that the inclusion of the third opening in the shank of the drill bit greatly reduces erosion on PDC cutters and/or the face of the drill bit. In doing so, the third opening can improve operation of the drill bit, e.g., by prolonging the operable life of the drill bit or of individual PDC cutters. The PDC cutters of a conventional drill bit, particularly the first row of PDC cutters, are exposed to drilling fluid flowing at high velocity. The inclusion of the third openings allows a portion of the drilling fluid to bypass the face of the bit head. As a result, the PDC cutters are exposed to substantially lower velocity of drilling fluid, reducing the erosion on each PDC cutter.

As a result of the reduced erosion, the PDC cutters of the drill bits described herein advantageously have a longer usable life. In some cases, the usable life of the PDC cutter can be described by the amount of time that the drill bit can be operated without need for replacing a cutter (e.g., due to damage to the cutter support, as described above). In some embodiments, the drill bit can be operated for at least 10 hours without need for replacing a PDC cutter, e.g., at least 12 hours, at least 15 hours, at least 18 hours, at least 20 hours, at least 22 hours, at least 25 hours, at least 30 hours, at least 35 hours, at least 40 hours, at least 45 hours, or at least 50 hours.

Embodiments

As used below, any reference to a series of embodiments is to be understood as a reference to each of those embodiments disjunctively (e.g., "Embodiments 1-4" is to be understood as "Embodiments 1, 2, 3, or 4").

Embodiment 1. A drill bit, comprising: a shank comprising a shank body defining a longitudinally extending shank bore, wherein the shank body includes at least one shank bypath extending from the shank bore to a shank outer surface; and a bit head connected to the shank, the bit head comprising a body comprising a gauge for engaging a side of a well bore and a face for engaging a bottom of the well bore, a plurality of blades separating a plurality of channels, wherein the plurality of channels extend radially along a portion of the face and extend longitudinally along a portion of the gauge, a central pathway formed through the body and in fluid communication with the shank bore for providing a fluid to the plurality of channels through at least one first opening, and wherein at least one of the plurality of blades comprises an edge on which is mounted a plurality of cutters arranged for shearing the bottom of the well bore.

Embodiment 2. The drill bit of embodiment 1, wherein the shank bypath extends radially from the shank bore to the shank outer surface.

Embodiment 3. The drill bit of embodiment 1, wherein the shank bypath has an average width from ⅛ to 1 inch.

Embodiment 4. The drill bit of embodiment 1, wherein the shank bypath extends radially from the shank bore to the shank outer surface.

Embodiment 5. The drill bit of embodiment 1, wherein the shank bypath extends from the shank bore to the shank outer surface at an angle $\alpha_2$ less than 90°.

Embodiment 6. The drill bit of embodiment 1, wherein the shank bypath extends from the shank bore to the shank outer surface at an uphole angle $\alpha_2$ from 10° to 80° relative to the longitudinal axis.

Embodiment 7. The drill bit of embodiment 1, wherein the shank bypath extends from the shank bore to the shank outer surface at an uphole angle $\alpha_2$ from 20° to 60°.

Embodiment 8. The drill bit of embodiment 1, wherein the shank bypath extends from the shank bore to the shank outer surface at an uphole angle $\alpha_2$ from 45° to 60°.

Embodiment 9. The drill bit of embodiment 1, wherein the shank bypath extends from the shank bore to the shank outer surface at a downhole angle $\alpha_2$ relative to the longitudinal axis.

Embodiment 10. The drill bit of embodiment 1, wherein the shank bypath extends from the shank bore to the shank outer surface at a downhole angle $\alpha_2$ greater than 90° and less than 135°.

Embodiment 11. The drill bit of embodiment 1, wherein the shank bypath extends from the shank bore to the shank outer surface at a downhole angle $\alpha_2$ from 100° to 130°.

Embodiment 12. The drill bit of embodiment 1, wherein the shank bypath extends from the shank bore to the shank outer surface at an angle $\alpha_2$ of about 90°.

Embodiment 13. The drill bit of embodiment 1, wherein the shank bypath includes a shank opening comprising a nozzle.

Embodiment 14. The drill bit of embodiment 1, wherein the bit head further comprises at least one bit bypath extending from the central pathway to a channel within a portion of the gauge.

Embodiment 15. The drill bit of embodiment 1, wherein the bit head does not include a bit bypath extending from the central pathway to a channel within a portion of the gauge.

Embodiment 16. The drill bit of embodiment 1, wherein each channel of the plurality the channels comprises a width, a depth, a combination of the width and the depth, or a cross-sectional area that is substantially constant within at least a portion of each of the plurality of channels.

Embodiment 17. The drill bit of embodiment 16, wherein the width and the depth of each of the plurality of channels remains substantially constant within the portion of each of the plurality of channels.

Embodiment 18. The drill bit of embodiment 16, wherein the cross-sectional area of each of the plurality of channels remains substantially constant within the portion of each of the plurality of channels.

Embodiment 19. A method for drilling a well bore through a subterranean formation, the method comprising: (a) rotating a drill bit comprising (i) a shank comprising a shank body defining a longitudinally extending shank bore, wherein the shank body includes at least one shank bypath extending from the shank bore to a shank outer surface; and (ii) a bit head connected to the shank, the bit head comprising a body comprising a gauge for engaging a side of a well bore and a face for engaging a bottom of the well bore, a plurality of blades separating a plurality of channels, wherein the plurality of channels extend radially along a portion of the face and extend longitudinally along a portion of the gauge, a central pathway formed through the body and in fluid communication with the shank bore for providing a fluid to the plurality of channels through at least one first opening, and a wherein at least one of the plurality of blades comprises an edge on which is mounted a plurality of cutters arranged for shearing the bottom of the well bore; (b) engaging the well bore with the plurality of cutters to form rock cuttings, wherein the rock cuttings are conveyed into the plurality of channels; and (c) pumping a fluid through at least a portion of the shank bore, through the shank bypath, and into an annular space between the shank outer surface and the side of the well bore.

Embodiment 20. The method of embodiment 19, further comprising pumping the fluid into the channels, wherein the fluid pumped into the channels provides a first volume of the fluid, wherein the fluid pumped into the annular space via the shank bypath provides a second volume of the fluid, and wherein the ratio of the first volume to the second volume is greater than 1.

Embodiment 21. The method of embodiment 19, wherein the fluid comprises a compressible pneumatic fluid.

Embodiment 22. The method of embodiment 19, wherein the fluid comprises drilling mud.

Embodiment 23. It should be appreciated that although selected embodiments of the drill bit and methods for using the drill bits are disclosed herein, numerous variations of these embodiments may be envisioned by one of ordinary skill that do not deviate from the scope of the present disclosure. The disclosure set forth herein encompasses multiple distinct inventions with independent utility. The specific embodiments described herein are illustrative and are not to be considered in a limiting sense as numerous variations are possible.

We claim:

1. A drill bit, comprising:

a shank comprising a shank body defining a longitudinally extending shank bore having a longitudinal axis, wherein the shank body includes at least one shank bypath extending from the shank bore to a shank outer surface, wherein an entirety of the at least one shank bypath is fully defined through the shank body; and a bit head welded to the shank, the bit head comprising a body comprising a gauge for engaging a side of a well bore and a face for engaging a bottom of the well bore, a plurality of blades separating a plurality of channels, wherein the plurality of channels extend radially along a portion of the face and extend longitudinally along a portion of the gauge, a central pathway formed through the body and in fluid communication with the shank bore for providing a fluid to the plurality of channels through at least one first opening, and wherein at least one of the plurality of blades comprises an edge on which is mounted a plurality of cutters arranged for shearing the bottom of the well bore.

2. The drill bit of claim 1, wherein the shank bypath extends radially from the shank bore to the shank outer surface.

3. The drill bit of claim 1, wherein the shank bypath has an average width from ⅛ to 1 inch.

4. The drill bit of claim 1, wherein the shank bypath extends from the shank bore to the shank outer surface at an angle $\alpha_2$ less than 90° relative to the longitudinal axis.

5. The drill bit of claim 1, wherein the shank bypath extends from the shank bore to the shank outer surface at an uphole angle $\alpha_2$ from 10° to 80° relative to the longitudinal axis.

6. The drill bit of claim 1, wherein the shank bypath extends from the shank bore to the shank outer surface at an uphole angle $\alpha_2$ from 20° to 60° relative to the longitudinal axis.

7. The drill bit of claim 1, wherein the shank bypath extends from the shank bore to the shank outer surface at an uphole angle $\alpha_2$ from 45° to 60° relative to the longitudinal axis.

8. The drill bit of claim 1, wherein the shank bypath extends from the shank bore to the shank outer surface at a downhole angle $\alpha_2$ relative to the longitudinal axis.

9. The drill bit of claim 1, wherein the shank bypath extends from the shank bore to the shank outer surface at a downhole angle $\alpha_2$ greater than 90° and less than 135° relative to the longitudinal axis.

10. The drill bit of claim 1, wherein the shank bypath extends from the shank bore to the shank outer surface at a downhole angle $\alpha_2$ from 100° to 130° relative to the longitudinal axis.

11. The drill bit of claim 1, wherein the shank bypath extends from the shank bore to the shank outer surface at an angle $\alpha_2$ of about 90° relative to the longitudinal axis.

12. The drill bit of claim 1, wherein the bit head further comprises at least one bit bypath extending from the central pathway to the channel within a portion of the gauge.

13. The drill bit of claim 1, wherein each channel of the plurality the channels comprises a width, a depth, a combination of the width and the depth, or a cross-sectional area that is substantially constant within at least a portion of each of the plurality of channels.

14. The drill bit of claim 13, wherein the width and the depth of each of the plurality of channels remains substantially constant within the portion of each of the plurality of channels.

15. The drill bit of claim 13, wherein the cross-sectional area of each of the plurality of channels remains substantially constant within the portion of each of the plurality of channels.

16. A method for drilling a well bore through a subterranean formation, the method comprising:

(a) rotating a drill bit comprising (i) a shank comprising a shank body defining a longitudinally extending shank bore, wherein the shank body includes at least one shank bypath extending from the shank bore to a shank outer surface, wherein an entirety of the at least one shank bypath is fully defined through the shank body; and (ii) a bit head welded to the shank, the bit head comprising a body comprising a gauge for engaging a side of a well bore and a face for engaging a bottom of the well bore, a plurality of blades separating a plurality of channels, wherein the plurality of channels extend radially along a portion of the face and extend longitudinally along a portion of the gauge, a central pathway formed through the body and in fluid communication with the shank bore for providing a fluid to the plurality of channels through at least one first opening, and a wherein at least one of the plurality of blades comprises an edge on which is mounted a plurality of cutters arranged for shearing the bottom of the well bore;

(b) engaging the well bore with the plurality of cutters to form rock cuttings, wherein the rock cuttings are conveyed into the plurality of channels; and (c) pumping a fluid through at least a portion of the shank bore, through the shank bypath, and into an annular space between the shank outer surface and the side of the well bore.

17. The method of claim 16, further comprising pumping the fluid into the channels via the at least one first opening, wherein the fluid pumped into the channels provides a first volume of the fluid, wherein the fluid pumped into the annular space via the shank bypath provides a second volume of the fluid, and wherein a ratio of the first volume to the second volume is greater than 1.

18. The method of claim 16, wherein the fluid comprises a compressible pneumatic fluid.

19. The method of claim 16, wherein the fluid comprises drilling mud.

* * * * *